United States Patent [19]

Vinson

[11] Patent Number: 4,886,112

[45] Date of Patent: Dec. 12, 1989

[54] METHOD FOR CLEANING EXTERIOR SURFACES OF FIRE-HEATED TUBES

[75] Inventor: George J. Vinson, Louisa, Ky.

[73] Assignee: Ashland Oil, Inc., Ashland, Ky.

[21] Appl. No.: 146,649

[22] Filed: Jan. 21, 1988

[51] Int. Cl.[4] ..... B24C 3/16

[52] U.S. Cl. ..... 165/95; 51/410; 51/319

[58] Field of Search ..... 51/410, 436, 439, 319, 51/317, 281 R; 165/95

[56] References Cited

U.S. PATENT DOCUMENTS

| | | | |
|---|---|---|---|
| 782,608 | 2/1905 | Jackson | 51/319 |
| 3,946,455 | 3/1976 | Echols et al. | 15/104.06 |
| 4,297,147 | 10/1981 | Nunciato et al. | 134/7 |
| 4,343,702 | 8/1982 | Riedal | 210/391 |
| 4,482,392 | 11/1984 | Pollock et al. | 134/7 |
| 4,579,596 | 4/1986 | Murzyn | 134/7 |
| 4,583,585 | 4/1986 | Estienne et al. | 165/94 |
| 4,655,846 | 4/1987 | Schorton | 165/95 |
| B1 4,655,846 | 6/1988 | Schorton | 165/95 |
| 4,699,665 | 10/1987 | Schorton | 165/95 |
| 4,773,357 | 9/1988 | Schorton | 165/95 |

FOREIGN PATENT DOCUMENTS

| | | | |
|---|---|---|---|
| 0034491 | 4/1923 | Denmark | 51/411 |
| 0606354 | 6/1985 | Japan | 51/411 |

OTHER PUBLICATIONS

Empire 780 Catalogue, Empire Abrasive Equipment Corporation Phila. Pa., Jun. 1979.

"Industrial Maintenance Painting", 3rd Edition, 1967, Nat'l Assoc. of Corrosion Engineers, Tx.

*Primary Examiner*—Frederick R. Schmidt
*Assistant Examiner*—Blynn Shideler
*Attorney, Agent, or Firm*—Richard C. Willson, Jr.; Stanley M. Welsh

[57] ABSTRACT

A method performable during operation of a fire heater for cleaning the fire heater tubes without significant adverse wear on the fire box of the fire heater or fire heater tubes to restore the heat transmission thereof. The method comprising: Impacting during the operation of fire heater tube exterior surfaces having a Burnell Hardness number of about 160—240, an abrasive particle speed of at least 625 feet per second, with said abrasive particles having a density of about 120—300 pounds per cubic foot and a particle diameter of about 0.04—2.80. millimeters.

4 Claims, 5 Drawing Sheets

METHOD FOR CLEANING EXTERIOR SURFACES OF FIRE-HEATED TUBES

BACKGROUND OF THE INVENTION

1. Field of the Invention

This invention relates to cleaning of fire-heated tubes. Fire-heated tubes provide indirect heating of a process stream from a fired furnace or fire box. These tubes are analogous to heat exchangers in that both involve indirect heat transfer from one medium to another. However, fire-heated tubes are not considered heat-exchanger tubes in the art. Heat exchangers are heat recovery systems primarily to transfer heat energy from one portion of a process to that of another, whereas fired heater tubes are process stream heaters that transfer heat only into the process, rather than from one portion to that of another in the process.

2. Prior Art

Cleaning interior surfaces of heat-exchanger tubes, even when in operation, is fairly well known. This is disclosed in the following U.S. Pat. Nos.: 3,946,455(1976); 4,297,147(1981); 4,343,702(1982); 4,482,392(1984); 4,579,596(1986); and 4,583,585(1986).

Cleaning exterior surfaces by a process commonly referred to as sand-blasting or grit-blasting is well known. In *Industrial Maintenance Painting* (Third Edition), published by National Association of Corrosion Engineers (1967) on page 14 and the following: Abrasive Blast Cleaning is disclosed as a very economical method for surface preparation.

Sand-blast cleaning is disclosed to be useful for tubular-type bundles, tower trays, pump casings and many other refinery items. In Petroleum Processing Handbook, edited by William F. Bland and Robert L. Davidson, published by McGraw-Hill Book Company, 1967, sandblast cleaning of the outside of tubular bundles is disclosed. However, there is no discussion for such cleaning while the tubular bundles are in service.

Fire heaters, such as sold by Petro-Chem Development Company, Inc., and Foster Wheeler, involve vertically oriented heat exchange conduits along generally cylindrical walls surrounding one or more burners. The burners directly impinge upon these conduits. Decomposition products of combustion form scaly, sulfur-containing coatings. These coatings are undesirable, because with time these coating give rise to an insulative layer that prevents the transfer of heat from the flame to materials being transported within the heat-exchanger tubes. Materials that are heated in such tubes include water and, more commonly, hydrocarbon-containing feedstreams. When the material within these heat-exchangers are hydrocarbon-containing material, they are often referred to as process heaters.

While in service, exterior surfaces of fired heat-exchanger tubes are at a temperature as high as 1500° F. (816° C.). The abrading agent must be at an appropriate impact velocity in order to insure that any scale formation or deposits of decomposition products are removable without damaging either the heater tubes or any of the other surfaces likely to be impacted by such abrading agent.

It is an object of this invention to define the method steps appropriate to cleaning fire-heated tubes while in operation.

A BRIEF DESCRIPTION OF THE INVENTION

Briefly, it has been found possible to clean while in service or operation exterior surfaces of fire-heated tubes without damaging the tubes to any significant degree or the fired heater itself. More specifically, external surfaces of fire heated tubes are impacted with abrasive particulates at a sufficient velocity to remove scale without damaging the tube and without significantly damaging or injuring other surfaces that may be impacted.

Specifically, a method has been found performable during operation of a fired heater for cleaning fired heater tubes without significant adverse wear on the fire box of the fired heater or fired heater tubes to restore the heat transmission efficiency thereof, said method comprising: impacting during operation of said fired heater exterior surfaces of said tubes having a Burnell Hardness Number in the range of about 160 to 240 with an abrasive particle at a speed in feet per second of at least 625, said particle being selected from the group consisting of particulates having: a density in pounds per cubic foot in the range of about 120 to 300 and particle diameters in millimeters (inches) in the range of about 0.04 (0.002) to 2.80 (0.11).

The factors found to impact operation of this invention are: the draft created by any flames inthe fire box of the fired heater, the density of the abrasive, the particle size of the abrasive, the surface roughness of the abrasive, and the velocity or speed of the abrasive, either at impact or as it exists a lance used to direct the abrasive particulates, and the distance between the exit of the lance used to direct the abrasive particles and the target fire heated tubes. All factors, except distance between lance exit and target tubes, and abrasive particulate density, being constant, the greater the distance, then the higher the density required. All other factors constant, smaller particulates have less impact and cleaning effectiveness. All other factors constant, particulates with rougher surfaces are more effective cleaners, and consequently lighter, smaller, and/or slower abrasives can be used with equal effectiveness to particulates with smoother surfaces which are by comparison heavier, larger, and/or faster.

The optimum round or smooth shot, for example, was found to have a density of about 275 lbs/cubic foot, whereas the optimum for irregular shot all other factors the same was found to be about 225 lbs/cubic foot.

FIG. 1 discloses a prior art arrangement for coupling a lance or conduit to a source for a mixture of abrasives and fluids under pressure.

FIG. 2 is a view along line 2—2 of FIG. 1 claw fittings 18 and 20.

DETAILED DESCRIPTION OF THE INVENTION

There are several risks associated with carrying out this invention. Some of these risks involve the following: (1) abrading the tubes to so great an extent that they might rupture, thereby, releasing whatever material is carried within these tubes into the fire box; (2) abrading the refractory behind the tubes, thereby, causing a path for heat to exterior walls that might lead to structural damage; (3) deformation of the lance in the fire box due to the very high temperatures of as much as 1500° F. (816° C.); (4) transmission of heat through the lance to an operator resulting in potential injury; and (5) buildup of abrasive particles within the fire box. We have discovered with respect to each of these potential risks that it is possible to operate in such a way as to avoid any problems. Specifically, with respect to problems associated with abrading the tubes we have found surprisingly that the tubes are not significantly injured when the impact velocity is controlled within the range in feet per second of about 625 to 935 and the tubes are made from a material having a hardness of at least 160, preferably at least 180, and most preferably at least 200 Burnell Hardness Number (BHN), but less than 240 BHN. We have also discovered that abrading particulates suitable for this invention include those made from an iron-base material which in the high temperatures of a fire box become iron oxides which then primarily leave in flue gases.

In summary, we have discovered that it is possible in the harsh environment of an in service furnace to clean deposits from fire-heated tubes without damage to the furnace or tubes.

The amount of combustion product deposits that form on fire heated tubes or heat-exchanger conduits depends to some degree upon the composition of the fuel being burned. As heavier bunker-type fuels are used, the amount of sulfur-containing species tends to increase and these tend to lead to more deposits on fire-heated tubes than from other more clean burning fuels. The cost savings, therefore, from this invention depends upon the nature of the fuel used. We have found, however, cleaning exterior surfaces can yield considerable fuel savings.

Figure 1:
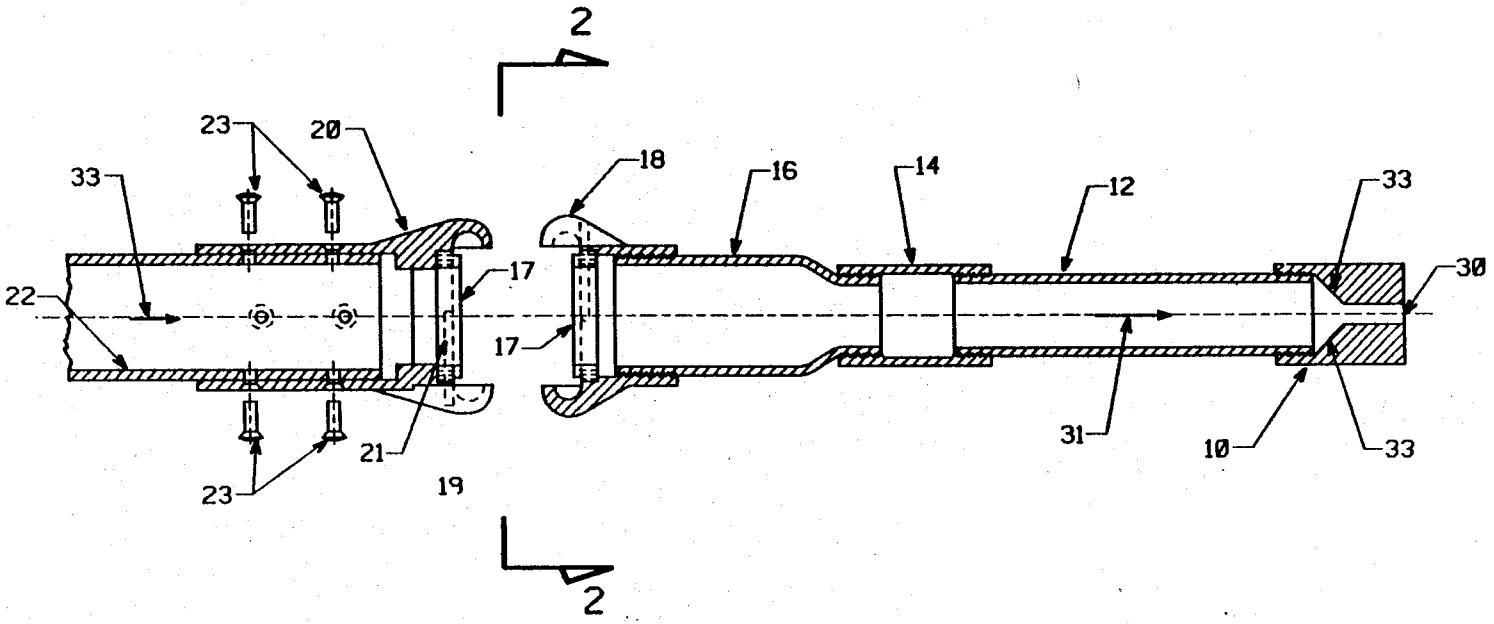
Figure 2:
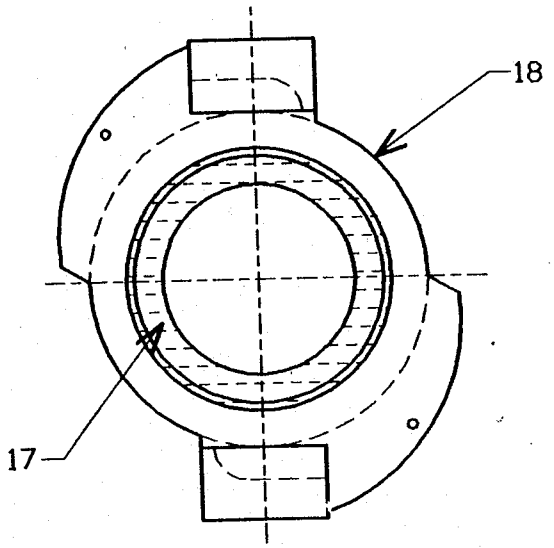

In FIG. 1, there is disclosed: a choke-10, a lance-12, a one-inch coupling-14, a reducing coupling-16, a claw fitting-18, gaskets-17, claw fitting-20, ridge-21, sandblast pipe-22, and pegs-23.

Figure 3:
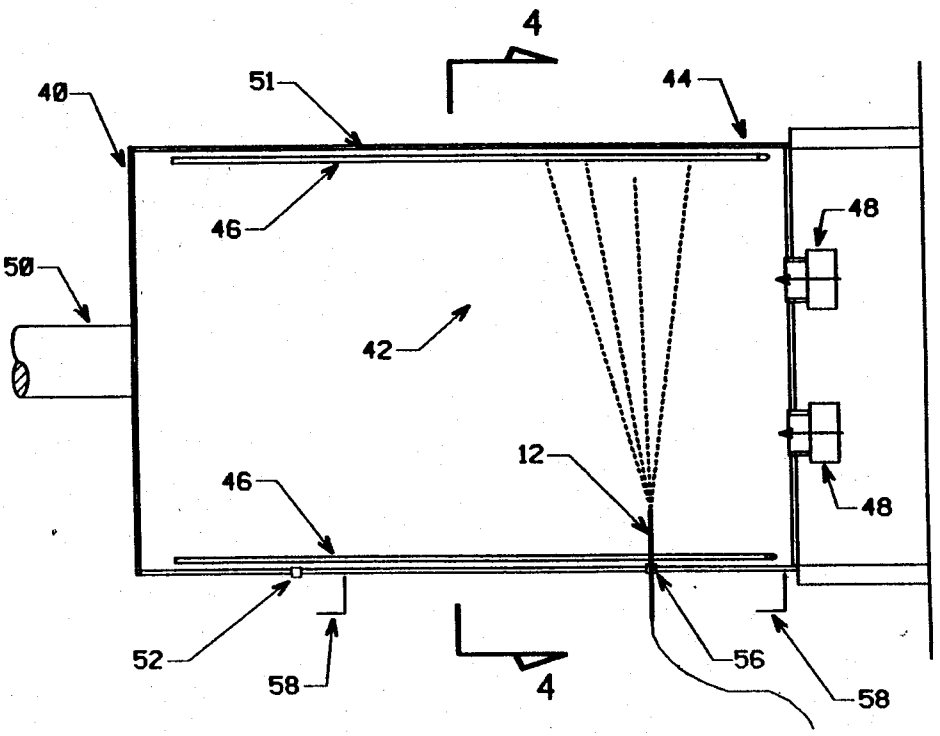
FIG. 3 is a schematic side-elevation view in cross-section of a conventional fire heated furnace in which are located heat-exchanger tubes.
Figure 4:
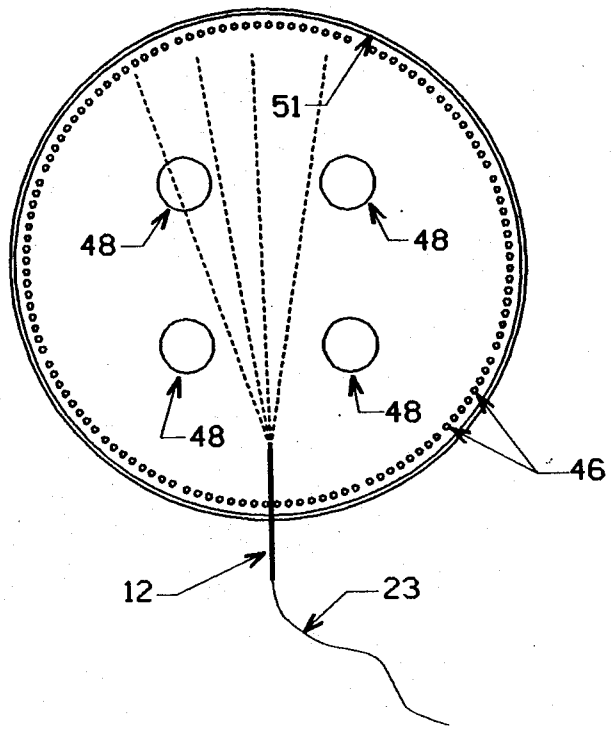
FIG. 4 is a schematic view along line 4—4 of FIG. 3.

In FIG. 3, there are disclosed: lance-12, a fire box or furnace-40, exterior walls-44, fire-heated tubes-46, burners-48, secondary extension-50, refractory-51, view port-52, view port-56, and platforms-58.

Briefly in operation the coupling shown in FIG. 1 works as follows: a choke-10 is threaded into connection with lance-12 so as to change the opening of lance-12 to that shown as opening-30 which is approximately three-quarters of an inch. Sloping walls-33 are part of choke-10 or become a feature of choke-10 as a result of attrition in a very short period of time from the abrading particulates which move in the direction of arrow-31 through lance-12. Lance-12 is threaded to a one-inch coupling-14. One-inch coupling-14 is threaded into connection with reducing coupling-16. Claw fitting-18 also is threaded into connection with reducing coupling-16. A symmetrical claw fitting-20 can snap into connection with claw fitting-18 and form a fluid tight seal with gaskets-17. Claw fitting-20 with peg-23 is in pressure and pegged coupling to sandblast pipe-22. Sandblast-22 is connected to a compressor capable of feeding a mixture of abrasive particulates and fluids, such as air, at as much as 750 cubic feet per minute (CFM) and 100 pounds per square inch (PSI).

Examples of suitable compressors and sandblast equipment are 750 CFM compressor as manufactured by Ingersoll Rand or Sullair, and 6 cubic feet sandblast pot and hoses and manufactured by Clemco or Schmidt Manufacturing. Examples of commercially available clamp fittings-18 and 20 are external sleeve type blast hose couplings of the universal type as manufactured by Clemco.

EXAMPLE

In a furnace with a fuel feed rate of about 900 barrels/day at about 1,600° F., fire heated with a No. 6 fuel ol, the initial operation in terms of percent of fuel heat value transferred to heat a hydrocarbon feed was 90.8%. Over a period of time, this efficiency was found to decrease to 89.4%. After cleaning in accordance with this invention the initial fuel efficiency was restored.

A lance-12 of 14 feet, 16 feet and 20 feet were used to determine the efficiency and practicality of operation and distribution pattern of abrading particle existing therefrom as shown in FIG. 3.

Figure 5:
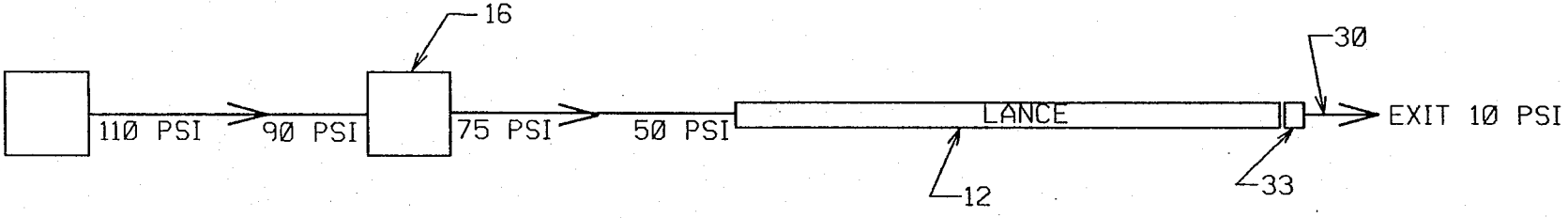
FIG. 5 is a schematic view of the system employed to propel abrasives into the fire box of a furnace, with the measured pressures given at various locations.

It was found that a 14-foot lance length was orientable and maneuverable but lances of much greater length than 16 feet were difficult to control. A lance with an inside diameter of one inch and a choke opening of three-quarters of an inch was found suitable when a compressor providing 750 cubic feet per minute (CFM) at 110 pounds per square inch (PSI) and operated at 10 PSI at the nozzle was used. The nozzle pressure was measured just prior to opening 30 in FIG. 1. The actual pressures used at various locations are shown in FIG. 5.

The density of materials tried was in the range of about 100 to 300 pounds per cubic foot. If the density of the material were too low, it was found that it was not possible to obtain a useful attrition or cleaning pattern because of the updraft from burners-48. It was necessary, in other words, to have a sufficiently dense shot to be able to work in the unusual environment of 1500° F. within a fire box. S170 and S110 (both round) and G50 and 80 (both irregular) steel shot were used. The mesh size distribution for these materials is given in the attached table. Silica sand was found unacceptable because of its low density.

| ASTM Mesh No. | mm | inch | 170 | 110 | G 50 | G 80 |
|---|---|---|---|---|---|---|
| 4 | 4.76 | 0.187 | | | | |
| 5 | 4.00 | 0.157 | | | | |
| 6 | 3.36 | 0.132 | | | | |
| 7 | 2.83 | 0.111 | | | | |
| 8 | 2.38 | 0.0937 | | | | |
| 10 | 2.00 | 0.0787 | | | | |
| 12 | 1.68 | 0.0661 | | | | |
| 14 | 1.41 | 0.0555 | | | | |
| 16 | 1.19 | 0.0469 | | | | |
| 18 | 1.00 | 0.0394 | | | | |
| 20 | .84 | 0.0331 | All Pass | | | |
| 25 | .71 | 0.0280 | 10% max | | All Pass | |
| 30 | .60 | 0.0232 | | All Pass | | |
| 35 | .50 | 0.0197 | | 10% max | | |
| 40 | .42 | 0.0165 | 85% min | | | All Pass |
| 45 | .35 | 0.0138 | 97% min | | | |
| 50 | .30 | 0.0117 | | 80% min | 65% | |
| 80 | .18 | 0.0070 | | 90% min | 75% | 65% |
| 120 | .12 | 0.0049 | | | | 75% |
| 200 | .07 | 0.0029 | | | | |
| 325 | .04 | 0.0017 | | | | |

Specific compositions, methods, or embodiments discussed herein are intended to be only illustrative of the invention disclosed by this Specification. Variations on these compositions, methods, or embodiments, such as combinations of features from various embodiments, are readily apparent to a person of skill in the art based upon the teachings of this Specification and are therefore intended to be included as part of the inventions disclosed herein. Any reference to literature articles or patents made in the Specification is intended to result in such articles and patents being expressly incorporated herein by reference including any articles or patents or other literature references cited within such articles or patents.

The invention which is claimed is:

1. A process for cleaning fire-heated tubes during operation of a fired heater having a width and fired heaters oriented to burn in a direction parallel to one of its axes by removing combustion product deposits from external surfaces of said tubes, said process comprising: impacting, while in operation, external surfaces of said tubes with an abrasive caused to move substantially across said width and transverse to said one of its axes at a velocity at impact of at least 625 feet/second.

2. The process of claim 1, wherein said abrasive comprises particulates having a density in the range of 120 to 300 pounds per cubic foot and particle sizes diameters in the range of about 0.04 to 2.8 millimeters (0.002 to 0.11 inches).

3. The process of claim 1, wherein said velocity at impact is in the range of about 625 to 935 feet/second.

4. In an operating fired heater having burners oriented to cause combustion products to flow in a direction substantially perpendicular to a diameter wherein said diameter is in the range of about 10 to 50 feet and fire-heated tubes have exterior surfaces at a temperature of at least 1,200° F. (649° C.), the improved process for removing combustion product deposits from exterior surfaces of said tubes comprising: impinging exterior surfaces of said tubes with an abrasive that has exited from a conduit having a length in the range of about 8 to 20 feet, an inside diameter in the range of 0.5 to 2 inches, an exit opening in the range ¾ inches to 15/16 inches, and oriented to cause said abrasive after transfer across a substantial fraction of said diameter transverse to said flow of combustion products to impact exterior surfaces of said heat-exchanger tubes; at a flow rate in the range of about 500 to 1,000 cubic feet per minutes of a mixture of said abrasive and a fluid carrier, wherein 30 to 70 percent by weight of total mass including both abrasive and fluid carrier, is abrasive, and said abrasive has a density in the range of about 120 to 300 pounds per cubic foot and a particle size, diameters in the range of about 0.04 to 2.8 millimeters (0.002 to 0.11 inches); and said mixture is under a pressure at the upstream entrance end to said conduit in the range 110 to 120 PSI.

* * * * *